US011521775B2

(12) United States Patent
De Natale et al.

(10) Patent No.: US 11,521,775 B2
(45) Date of Patent: Dec. 6, 2022

(54) ELECTRONIC COMMAND AND CONTROL DEVICE FOR AN ELECTROMAGNETIC ACTUATOR AND ELECTROMAGNETIC ACTUATOR THEREOF

(71) Applicant: LMP SRL, Pomigliano d'Arco (IT)

(72) Inventors: Gabriele Valentino De Natale, Napoli NA (IT); Fedele D'alessandro, Pomigliano d'Arco NA (IT)

(73) Assignee: LMP SRL, Pomigliano d'Arco (IT)

( * ) Notice: Subject to any disclaimer, the term of this patent is extended or adjusted under 35 U.S.C. 154(b) by 0 days.

(21) Appl. No.: 17/388,183

(22) Filed: Jul. 29, 2021

(65) Prior Publication Data

US 2022/0044856 A1 Feb. 10, 2022

(30) Foreign Application Priority Data

Aug. 5, 2020 (IT) ..... 102020000019366

(51) Int. Cl.
*H01F 7/18* (2006.01)

(52) U.S. Cl.
CPC ..... *H01F 7/1805* (2013.01); *H01F 7/1844* (2013.01)

(58) Field of Classification Search
CPC ..... H01F 7/1805; H01F 7/1844; H01H 47/32; H01H 47/04
USPC ..... 361/154
See application file for complete search history.

(56) References Cited

U.S. PATENT DOCUMENTS 5,621,603 A * 4/1997 Adamec ..... H03K 17/0822 361/187
2012/0106021 A1 5/2012 Suchoff
2015/0069280 A1* 3/2015 Bennek ..... H01F 7/127 251/129.15
2018/0068817 A1* 3/2018 Geffroy ..... H01H 47/002

FOREIGN PATENT DOCUMENTS

EP 0400389 A2 12/1990
EP 1109178 A2 6/2001

OTHER PUBLICATIONS

Search Report and Written Opinion for Italian Application No. 102020000019366 dated Mar. 30, 2021.

* cited by examiner

*Primary Examiner* — Thienvu V Tran
*Assistant Examiner* — Sreeya Sreevatsa
(74) *Attorney, Agent, or Firm* — Pearne & Gordon LLP

(57) ABSTRACT

A device for the command and control of the electric power supply of windings of an electromagnetic actuator, comprising a plurality of electronic means configured to receive at the input either a direct current feeding voltage or alternatively an alternating current feeding voltage and to generate at the output a first digital command signal triggering an activation phase of the electromagnetic actuator in which at least one of the windings is powered, for a first predefined and adjustable time interval, with an activation current, a second digital command signal triggering a maintenance phase of the electromagnetic actuator in which the windings are powered with a maintenance current having an intensity lower than the activation current, and a third digital command signal triggering a third phase of deactivation of the electromagnetic actuator in which the power supply of the windings is interrupted for a second predefined and adjustable time interval.

8 Claims, 4 Drawing Sheets

ELECTRONIC COMMAND AND CONTROL DEVICE FOR AN ELECTROMAGNETIC ACTUATOR AND ELECTROMAGNETIC ACTUATOR THEREOF

This application claims priority to Italian Patent Application 102020000019366 filed Aug. 5, 2020, the entire disclosure of which is incorporated by reference herein.

The present invention relates to an electronic command and control device for an electromagnetic actuator and a related electromagnetic actuator comprising such electronic device.

In the field of electrical circuitry, the use of electromagnetic actuators intended to control an electrical circuit, for example by means of an associated circuit breaker, is well known and widespread.

Essentially, electromagnetic actuators comprise a fixed part having an electromagnet on which one or more windings are wound, and an associated mobile magnetic circuit, also referred to as mobile armature, the movement of which controls the opening or closing of electrical circuits by means of optional additional transduction and amplification systems. For example, in a medium-voltage mechanical circuit breaker, the main contacts are moved by a mechanism actuated by means of two opening and closing springs that act as an amplification system; the release of the springs is electrically controlled by electromagnetic actuators referred to as opening/closing coils.

The movement of the armature is governed by the variation of a magnetic field and any additional devices suitable for bringing the mobile armature into a stable resting position; typically, a spring tending to retain the mobile armature and place it in the stable resting position is used.

The variation of the magnetic field is obtained when an electrical current is injected in the electrical windings of the electromagnets. The magnetic field generated by the electromagnet is proportional to the current applied and the number of turns. The resulting attraction force exerted on the mobile armature is proportional to the intensity of the magnetic field and inversely proportional to the square of the distance, i.e. the air gap, between the electromagnet and the mobile armature.

In some applications, one or more permanent magnets are inserted into the actuator. Typically, their magnetic field is effective when the mobile armature is in the vicinity of the electromagnetic; thus, they are used to provide a second stable position or assist the action of the electromagnet.

In the case of bistable actuators having permanent magnets, the movement of the armature from one stable position to another may be controlled by the electromagnet acting on the polarity of the excitation current.

In the prior art, the excitation of the windings is realized by means of simple switches that merely circulate a current, the value of which is proportional to the voltage applied and inversely proportional to the resistance of each winding, so as to produce a magneto-motive force that is given by the product of the number of turns and the current circulating in the winding, or by current partializing systems that allow for the regulation of the current at desired levels although limited by the available voltage and the resistance of the winding.

Although known electronic command and control devices and related currently available magnetic actuators do adequately serve their intended purpose, there remain certain aspect suitable for further improvement.

For example, one technical limitation that occurs in certain prior-art solutions is the lack of compatibility with various power sources, not only in terms of type, i.e. DC or AC, but also in terms of the supply voltages, which may vary, e.g., from 12 V to 510 V and beyond.

Other issues that are not always, or only partially solved, case by case, include, for example: the intervention and/or non-intervention thresholds, which differ from market to market; the timing related to the delays or speed of activation/deactivation of the actuators; the possible compatibility with diagnostic systems; a sufficient resistance to temperature variations; the necessary electromagnetic compatibility, in particular with low emission levels and elevated immunity levels.

Last, but not least, there are issues related to the total lifecycle cost of the products, compactness, miniaturisation, and integration into the end product.

Thus, the main aim of the present invention is to provide a solution that addresses and improves at least some of the aforementioned issues.

In particular, within this aim, an objective of the present invention is to provide a command and control device for an electromagnetic actuator and a related electromagnetic actuator that can be used both with DC and AC feeding current, and with a wide range of supply voltages.

Another objective of the present invention is to provide a command and control device for an electromagnetic actuator and a related electromagnetic actuator that are compatible with diagnostic devices, in which it is possible to flexibly regulate the intervention/non intervention thresholds and, in which it is possible to use and regulate in a relatively easy manner timing related to delays of activation and/or deactivation speeds of the electromagnetic actuators.

An additional objective of the present invention is to provide a command and control device for an electromagnetic actuator that is versatile, highly reliable, easy to produce at competitive costs, that provides sufficient resistance to environmental agents, and has low emissions levels and high electromagnetic immunity levels.

This aim, as well as these and other objectives that will become more evident from the following description, are achieved by an electronic device for the command and control of the electric power supply of one or more windings of an electromagnetic actuator, wherein it comprises a plurality of electronic means configured to receive at the input either a direct current feeding voltage or alternatively an alternating current feeding voltage and to generate at the output a first digital command signal suitable for triggering an activation phase of the electromagnetic actuator in which at least one of said one or more windings is powered, for a first predefined and adjustable time interval, with an activation current, a second digital command signal suitable for triggering a maintenance phase of the electromagnetic actuator in which said one or more windings are powered with a maintenance current having an intensity lower than said activation current, and a third digital command signal suitable for triggering at least a third phase of deactivation of the electromagnetic actuator in which the power supply of said one or more windings is interrupted for at least a second predefined and adjustable time interval.

The aforementioned aim, as well as these and others objectives that will become more evident from the following description, are also achieved by an electromagnetic actuator comprising one or more windings, and at least one device for the command and control of the electric power supply of said one or more windings, wherein said at least one device comprises a plurality of electronic means configured to receive at the input either a direct current feeding voltage or alternatively an alternating current feeding voltage and to generate at the output a first digital command signal suitable for triggering an activation phase of the electromagnetic actuator in which at least one of said one or more windings is powered, for a first predefined and adjustable time interval, with an activation current, a second digital command signal suitable for triggering a maintenance phase of the electromagnetic actuator in which said one or more windings are powered with a maintenance current having an intensity lower than said activation current, and a third digital command signal suitable for triggering at least a third phase of deactivation of the electromagnetic actuator in which the power supply of said one or more windings is interrupted for at least a second predefined and adjustable time interval.

Further characteristics and advantages of the invention will become clearer from the following detailed description of possible embodiments, illustrated by way of example only, and by reference to the drawings appended hereto, wherein.

It should be noted that, in the following detailed description, components that are identical or similar from the structural and/or functional standpoint may be indicated by the same reference numbers, regardless of whether they are shown in different embodiments or components of this description. It should be further noted that, for the sake of clarity and conciseness, the drawings are not necessarily to scale, and certain characteristics of the description may be shown in a relatively schematic manner.

In addition, where the term 'configured' or 'adapted', or the like, is used herein with reference to any component or part thereof, it has to be understood as comprising the structure and/or configuration and/or form and/or position of the component or part it refers to. In particular, when such terms refer to electronic hardware or software means, they should be understood to include electronic circuits or parts thereof, as well as software/firmware, e.g. algorithms, routines, and programs in general, running and/or resident on any storage medium.

Lastly, in the description and appended claims, ordinal numbers such as 'first', 'second', 'third', etc. are used for the sake of clarity of description only, and by no means they are to be construed as limitations; in particular, the indication of a circuit block, e.g., as 'fourth' does not necessarily imply the presence or strict necessity of the preceding 'first', 'second', or 'third' blocks, unless their presence is clearly required for the proper functioning of the device or an embodiment thereof, nor do the order and related numbering necessarily need to be those described in the exemplary embodiments disclosed.

Figure 1:
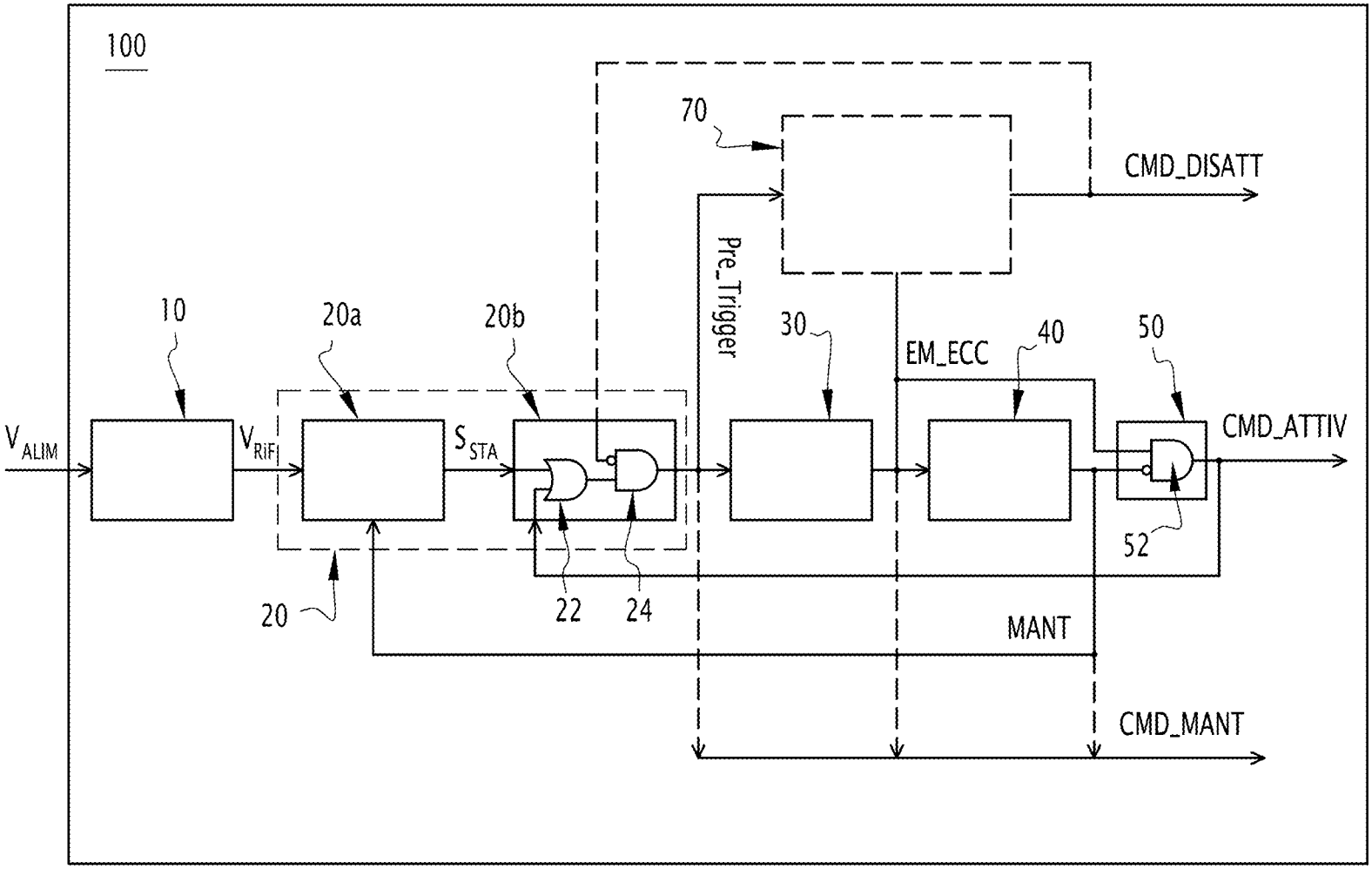
FIG. 1 is a block diagram schematically illustrating one embodiment of a command and control device according to this invention.
Figure 2:
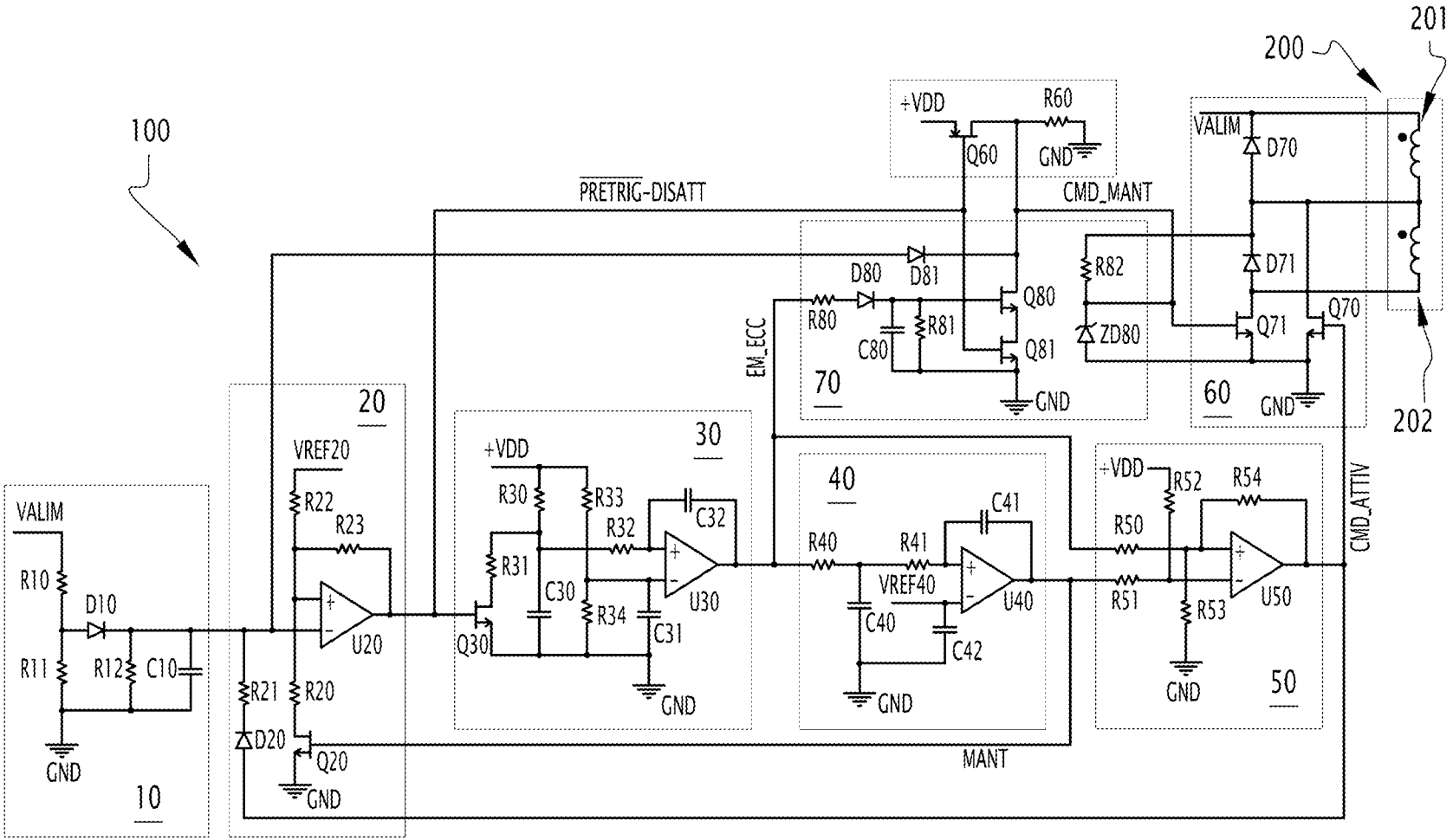
FIG. 2 shows one possible circuital embodiment of the command and control device according to the invention.

FIG. 1 is a schematic illustration of a command and control device according to the invention, indicated as a whole by the reference number 100, which is intended for controlling an electromagnetic actuator, e.g. a circuit breaker, schematically represented in FIG. 2 by reference number 200.

In a manner that is known and thus not illustrated in detail, the actuator 200 comprises at least one fixed electromagnet around which one or more windings are wound, and a mobile part or movable armature that, as a function of the presence of a magneto-motive force induced by the electrical excitation of the one or more windings, moves between a position near the fixed electromagnet (excited windings) and a position spaced apart from it (non-excited windings).

FIG. 2 shows one possible circuital embodiment of the various blocks of the device 100 of FIG. 1, which can be used, for example to provide DC excitation of an electromagnet having dual 'activation' and 'maintenance' windings, with and without diagnostic functions; the activation winding is indicated in FIG. 2 by reference number 201, and is connected in series to a maintenance winding indicated by reference number 202.

In particular, as a whole, and as will result in greater detail from the following description, the device 100 according to the invention comprises a plurality of electronic means (which can be alternatively referred to also as electronic circuits or circuital blocks or electronic units or electronic modules) configured so as to receive in input a supply voltage either in alternating current (AC) or in direct current (DC), and to generate at the output: a first digital control signal, indicated hereinafter and in FIG. 1 as CMD_ATTIV, that is suitable for triggering an activation phase of the electromagnetic actuator, in which at least one of the one or more windings, in particular only the activation winding, is supplied with an activation current for a first predefined, and adjustable time interval; a second digital control signal, indicated hereinafter and in FIG. 1 as CMD_MANT, suitable for triggering a maintenance phase of the electromagnetic actuator, in which all of the windings are supplied with a maintenance current having an intensity lower than that of the activation current; and a third digital control signal, indicated hereinafter and in FIG. 1 as CMD_DISATT, suitable for triggering at least one third deactivation phase of the electromagnetic actuator 200, in which the power supply of all of the windings is interrupted for at least one second predefined and adjustable time interval.

In the embodiment shown, the device 100 comprises a first circuit block, or circuit for measuring the supply voltage and envelope detector, indicated as a whole in FIGS. 1 and 2 by the reference number 10, which is configured to generate, at its output, a reference voltage $V_{RIF}$ adjusted to a desired value in response to the value of a supply voltage value $V_{ALIM}$ received at its input, which can either in direct current (DC) or in alternating current (AC).

In practice, the first circuit block 10 receives, at its input, the supply voltage $V_{ALIM}$ of the actuator 200, and, after appropriate scaling and any necessary rectification, processes it via an envelope detector 12.

In particular, as shown in the circuitry embodiment of FIG. 2, the first circuit block 10 comprises, e.g., a voltage divider for measuring the supply voltage, implemented by the two resistors R10 and R11, and an envelope detector 12 formed by a diode D10, a capacitor C10 connected in parallel to a resistor R12.

In the case of DC power supply, the envelope detector 12 does not introduce significant variations to the input signal except during the activation and deactivation transients. In the case of an AC power supply, the output signal of the envelope detector 12 approximates the sequence of the maximum values of the supply voltage $V_{ALIM}$ of the actuator 200, and between a maximum peak and the next one, the output signal decreases exponentially and with a constant of time equal to RC until it meets again and chases the input signal.

Usefully, the R and C values are selected such that, at a steady state, the minimum values of the output signal $V_{RIF}$ approximate the effective value of the input signal; in this way, with a sinusoidal AC supply signal at a known frequency, it is possible to measure the effective value of the voltage. It should further be noted that this allows measuring, with a good approximation, the peak value and the effective value of sinusoidal AC variables in a time comparable to the period of the signal itself; as such, this solution reduces the response time for both DC and AC feeding types compared to other solutions used in the prior art.

In an alternative embodiment, not shown in the drawings, the envelope detector 12 comprises a microprocessor configured so as to process the supply voltage signal $V_{ALIM}$ received at the input and provide the desired reference voltage signal $V_{RIF}$ at its output.

As shown in FIGS. 1 and 2, downstream of the first circuit block 10, there is provided a second circuit block 20, or thresholds detection and logic circuit, that receives, at its input, at least the reference voltage signal $V_{RIF}$ generated at the output of the first circuit block 10, and, as a whole, is configured so as to generate, at its output, a signal indicating the phase into which the electromagnetic actuator 200 should be brought, hereinafter and in FIG. 1 indicated as Pre_Trigger, in particular, this signal Pre_Trigger can be alternatively be a preactivation signal indicating that the conditions are suitable for bringing the electromagnetic actuator 200 to the activation phase by supplying power only to the activation winding (or the activation windings if there is a plurality thereof) with the activation current, or a pre-deactivation signal indicating that conditions are suitable for bringing the electromagnetic actuator 200 into the deactivation phase by terminating the power supply to all windings.

In particular, the second block 20 comprises first electronic means, i.e. a first circuital part for detection of thresholds and hysteresis, schematically indicated in FIG. 1 by reference number 20*a*, and second electronic circuit logic means, schematically indicated in FIG. 1 by reference number 20*b*.

The first electronic means 20*a* receive, at their input, at least the reference voltage signal $V_{RIF}$ generated at the output of the first circuit block 10, and, in particular, by its envelope detector 12, and compare it with a threshold value; the result of the comparison results in the generation of a reference signal $S_{STA}$ that establishes the operative state into which the actuator 200 should be brought, i.e. the activation or deactivation or rest phase with no power supply to the windings.

Conveniently, the comparator includes a hysteresis having sufficient amplitude to prevent oscillations of the output signal that may be caused by noise and/or disturbances from any source.

Usefully, in the device 100 according to the invention, the comparison threshold of the second circuit unit 20 may be fixed or variable as a function of the current state of the actuator 200. In the latter case, the first electronic means 20*a* also receive, at their input, a digital control signal MANT that identifies the active operative state or power supply maintenance phase of the windings of the actuator 200.

In particular, when the actuator 200 is at rest, i.e. none of its windings is supplied with electrical power, the signal MANT is inactive, and, as such, an activation threshold is selected in the threshold detection means 20*a*; on the other hand, when the actuator 200 is in the active state, i.e. its windings are supplied with power in the maintenance phase, the signal MANT is active, and, as such, the deactivation threshold is selected.

The reference signal $S_{STA}$ that determines the state into which the actuator 200 should be brought, is supplied at the input of the second electronic circuit logic means 20*b*, so as to generate, at the output, the aforementioned pre-activation or alternatively pre-deactivation signal Pre_Trigger that indicates that the conditions for the activation or deactivation of the windings of the actuator are present.

More specifically, the reference signal $S_{STA}$ is supplied at the input of a first OR logic gate 22 together with the first digital control signal CMD_ATTIV, which is suitable for triggering the activation phase of the power supply of the one or more windings of the actuator 200 (generated by a control unit 50, as it will be described in greater detail hereinafter). For example, the logic gate 22 prevents the interruption of the actuation of the actuator 200 by a disturbing signal acting on the power supply. Such a disturbance may be caused by voltage drops in the power cables, induced by the same current required by the windings of the actuator 200; these would cause an unstable oscillatory behaviour characterised by repeated activations and deactivations of the actuator 200, which could result in malfunctions and even serious damages to the actuator 200. The use of this solution makes it possible, for example, to make the device 100 faster than known solutions that act on the filter of the signal related to the supply voltage and make the system slower, and to validate the voltage signal over the entire duration of the start-up delay, as will result in greater detail in the following description, unlike known solutions in which the hysteresis of a comparator is widened until it coincides with the release threshold.

In one possible embodiment of the device 100, shown in FIGS. 1 and 2, the second circuit part 20*b* comprises a second AND logic gate 24, e.g. with a denied entry, which has a function that is practically the opposite of the first OR gate 22.

As will be seen in greater detail in the following description, the second logical AND gate 24 can advantageously be used in combination with diagnostic systems for monitoring the continuity of the windings, and, in practice, prevents a deactivation command CMD_DISATT from being interrupted due to the action of the diagnostic devices themselves. In fact, the latter inject a control current into the power supply of the actuator 200, which, in the absence of a load of the windings, causes a rapid rise in the supply voltage until the activation threshold is exceeded and the deactivation is thus interrupted.

Essentially, the chain of the circuit block 20*a* and the two gates 22 and 24 allows separating various disturbance sources and managing them in the most appropriate way.

In the exemplary circuitry embodiment shown in FIG. 2, the circuit parts related to thresholds detection and the logic of the block 20 are implemented by the following components, connected as shown therein. In particular, the comparator with hysteresis comprises a comparator U20 with a push-pull output (low=>GND, high=>+VDD), and the digital output signal of this unit PRETRIG_DISATT is active "low" when the envelope of the supply voltage is greater than the activation threshold, with the latter being determined by the reference threshold value VREF20 and the resistors R22 and R23. The threshold selector, in turn, comprises the MOSFET Q20 and the resistor R20. The activation of the MOSFET Q20 causes a reduction in the threshold from the actuation value of the actuator to the deactivation value, and both thresholds and related hysteresis are determined by the value of the reference signal VREF20 and the resistors R22, R23, and R20.

The OR logic gate 22 comprises the diode D20 and the resistor R21, in which the presence of a signal active "high" on the anode of the diode D20 forces the output signal of the comparator into the active (low) state once the relationship between the resistors R21 and R12 has been appropriately determined. The AND logic gate 24, in turn, comprises the diode D81, and the presence of a signal active low on the cathode of the diode D81 forces the output signal of the comparator into the deactivated high state (+VDD).

Usefully, in the device 100 according to the invention, the signal Pre_Trigger at the output of the second circuit block is subject to an appropriate validation by means of one or more additional blocks.

To this end, in one possible embodiment, as shown in FIGS. 1 and 2, in the device 100 according to the invention, downstream of the second circuit unit 20, optionally there is provided an additional circuit unit 30, hereinafter referred to as third circuit block 30 or validation circuit of an excitation command for the actuator 200, which is configured to emit an excitation command EM_ECC for the actuator 200 following a definitive validation. In practice, the unit 30 receives in input, the pre-activation signal Pre_Trigger and, only after the signal received at the input has been kept active for a predetermined period of time, or activation delay, which can be appropriately configured, generates, at its output, a signal EM_ECC that is suitable for determining the actual excitation, and thus the power feeding of the activation windings of the actuator 200 with the activation current. If, during this time period, the signal in input to the circuit block 30 becomes inactive, even for a moment, the activation command is not validated, and the signal EM_ECC will thus remain inactive, and the pre-activation signal Pre_Trigger at the input will have to be reactivated and remain activated for the entire selected time delay. Delaying the activation command is particularly useful as an additional filter for any disturbances to the power supply, and is particularly important for certain applications, e.g. tripping relays of medium-voltage circuit breakers. Furthermore, the validation block 30 of the excitation signal, in combination with the envelope detector 12, allows for the activation and deactivation thresholds to be selected independently from the type of power supply in direct current DC or in sinusoidal alternate current AC. In fact, as above indicated, in the device 100 according to the invention, in the event of an AC power supply, the minimum output values of the envelope detector 12 coincide substantially with the effective value of the voltage in alternate current and with the equivalent effective voltage in direct current CC. The minimum value of the envelope also depends on the frequency of the sinusoidal voltage; to this end, if compatibility with both 50 Hz and 60 Hz systems is desired, a suitable compromise between the two frequencies can be configured.

In the exemplary embodiment shown in FIG. 2, the validation circuit 30 of the excitation command comprises a MOSFET Q30, the gate of which is connected to the input signal PRETRIG_DISATT. When the signal is at the active (low) level, the capacitor C30 is charged via the resistor R30; if, on the other hand, it is at the inactive (high) level, the capacitor C30 is discharged nearly instantaneously via the resistor R31, which preferably has a very low value, useful for limiting the peak of the discharge current circulating in the MOSFET Q30. In particular, when the voltage at the ends of the capacitor C30 reaches a predetermined threshold value, the output signal EM_ECC becomes active (high), indicating that the windings of the actuator 200 must be activated and thus supplied with power. The resistor R32 and the capacitor C32 serve to introduce a dynamic hysteresis and render the commutations of the signal EM_ECC immune to oscillations. For example, the comparator U30 is a comparator with a push-pull output.

The activation delay depends exclusively on the appropriate value of the resistors R30, R33, R34 and the capacitor C30, and is independent from the supply voltage +VDD, which thus need not be regulated with particular precision, thus allowing for a reduction in the cost of the power supply circuits. The capacitor C31, in turn, serves to further attenuate any disturbances.

If the signal Pre_Trigger at the output of the second circuit block 20 is a pre-deactivation signal, and the unit 30 is implemented in the device 100, this unit operates substantially transparently in relation to the pre-deactivation signal, i.e. it does not influence it or process it in any way, and the pre-deactivation signal Pre_Trigger is entered in input into an additional circuit block 40, hereinafter referred to also as fourth block or activation/deactivation timing circuit. Furthermore, the block 40 receives, at its input, the excitation signal EM_ECC, which, in practice, corresponds to the signal Pre_Trigger properly validated by the unit 30. If instead the unit 30 is not implemented, the block 40 receives the preactivation or pre-deactivation signal Pre_Trigger transmitted by the block 20 directly at its input and processes it appropriately, as detailed below.

In particular, as shown in FIGS. 1 and 2, the fourth circuit block 40 receives, at its input, the signal originating directly from the block 20 or the block 30, if implemented, and generates at its output the digital control signal MANT, which is active when all windings of the electromagnetic actuator 200, e.g. both windings 201 and 202 in the example of FIG. 2, are excited in a maintenance phase. In particular, if the validation unit 30 is not implemented, the signal received at the input of the unit 40 is the signal Pre_Trigger, which may be a preactivation or a pre-deactivation signal; if, on the other hand, the validation unit 30 is implemented, the signal received at the input of the timing unit 40 is signal Pre_Trigger for the pre-deactivation of the windings, or the validated signal EM_ECC that is suitable for determining the actual excitation, and thus the power feeding of the activation windings of the actuator 200 with the activation current.

As previously indicated, the digital control signal MANT is supplied to the input of the thresholds detection and hysteresis block 20, and also controls the switching of the relevant thresholds therein set when they are variable, selecting, for example, the deactivation threshold in the maintenance phase; in practice, in this example, the device stands by for a variation in the supply voltage which requires the deactivation of the electromagnet.

A change in the state of the signal MANT follows that of the excitation validated signal EM_ECC/preactivation signal (Pre_Trigger of preactivation), or alternatively that of the pre-deactivation signal Pre_Trigger with varying delays, and, in particular:

- activation is preferably delayed by an interval of time that establishes the duration of the activation pulse of the electromagnet of the actuator 200;
- deactivation is preferably delayed by an interval of time that establishes the immunity of the actuator 200 to any temporary drops in supply voltage. In fact, as long as the signal MANT remains active, the threshold remains a deactivation threshold, and activation pulses, which may be harmful to the integrity of the actuator itself due to releasing elevated power levels, cannot be generated.

In practice, the activation/deactivation circuit 40 establishes a first time interval during which the digital command CMD_ATTIV must remain active, thus allowing the activation windings to be supplied with the activation current, and a second time interval during which the signal MANT must remain active, wherein both time intervals can be predefined and regulated as necessary.

In the exemplary embodiment of FIG. 2, the activation/deactivation timing circuit comprises the components operatively connected as shown. In particular, the activation time corresponds substantially to the charging time of the capacitor C40 from the value GND up to the voltage threshold value VREF40. The duration of the immunity to voltage drops corresponds to the discharge of the capacitor from the value+VDD to the threshold value VREF40. This time may be set as needed by acting on the values of the resistor R40, the capacitor C40, and the threshold VREF40. The resistor R41 and the capacitor C41 provide a dynamic hysteresis that is adequate to avoid oscillations in the output signal, whilst the capacitor C42 ensures further attenuation of any interference.

In the embodiment shown, the device 100 further comprises a fifth circuit block or activation command logic circuit 50 that controls the effective electrical excitation of the electromagnet in the activation mode.

In particular, this circuit 50 comprises for example an AND logic gate 52, e.g. with denied entry, which generates the digital activation command CMD_ATTIV when the signal EM_ECC (actuator excited) is active and the signal MANT is inactive.

In the exemplary embodiment of FIG. 2, the AND logic gate 52, which generates the activation command CMD_ATTIV, comprises a push-pull comparator U50 that is used to implement an AND logic gate with denial of entry. The resistor R54 implements a hysteresis that is useful to render the transitions of the signal CMD_ATTIV free of oscillations. The values of the resistors R50, R51, R52, and R53 are suitably selected so as to comply with the following formula:

$$2*R50=2*R51=R52=R53$$

and obtain the following table:

| EM_ECC | MANT | CMD_ATTIV |
|---|---|---|
| 0 | 0 | 0 |
| 1 | 0 | 1 |
| 1 | 1 | 0 |
| 0 | 1 | 0 |

Advantageously, in the device 100 according to the invention, the maintenance command signal CMD_MANT can be generated by selecting any of the signals selected from: the signal Pre_Trigger generated at the output of the second circuit unit 20; the signal EM_ECC generated at the output of the third circuit unit or validation circuit 30; or directly the digital signal MANT generated at the output of the fourth unit or activation/deactivation timing circuit 40.

In a preferred embodiment, the digital command CMD_MANT is generated from the preactivation/pre-deactivation signal Pre_Trigger at the output of the block 20. In this way, during the activation phase of the actuator 200, this selection allows using the current absorption by the windings of the actuator 200 as an additional filter for disturbances of the power supply; in fact, in the event of disturbances to the power supply signal sufficient to cause inappropriate activation of the actuator 200, the disturbances are absorbed during the time delay, thus attenuating the supply voltage down to levels below the activation threshold and impeding the activation of the actuator, whilst, in the deactivation phase of the actuator 200, the power supply to the windings of the electromagnet is immediately interrupted, and, thus, no additional delays are introduced to the already long periods of time necessary in order for the recirculating currents to be exhausted and for the magnetic field to be reduced to a sufficient degree such that the mobile armature of the actuator rapidly moves away from the electromagnet.

For example, in the block diagram of FIG. 1, the signal CMD_MANT coincides with the preactivation signal Pre_Trigger (the latter being active high when conditions are suitable for the electromagnetic actuator 200 to be brought into the activation phase) or with the predeactivation signal Pre_Trigger (the latter being active low when conditions are suitable for the electromagnetic actuator 200 to be brought into the deactivation phase).

In the example shown in FIG. 2, the circuit part related to the maintenance command comprises, for example, the resistor R60, which normally maintains the signal CMD_MANT inactive low, whilst the MOSFET Q60 is a P-channel MOSFET connected so as to invert the signal PRETRIG_DISATT. When the signal PRETRIG_DISATT is active at a low level, the MOSFET Q60 conducts and activates the signal CMD_MANT.

In this exemplary embodiment, the signal CMD_MANT coincides, e.g., with the inverse of the pre-deactivation signal Pre_Trigger PRETRIG_DISATT (the latter being active at a low level when conditions are suitable for bringing the electromagnetic actuator 200 into the activation phase, and active at a low level when, on the other hand, conditions are suitable for bringing the electromagnetic actuator 200 into the deactivation phase); the inversion is carried out by the MOSFET Q60 and the resistor R60.

FIG. 2 further shows an example of a power circuit having the reference number 60, which is adapted so as to convert the excitation command signals CMD_ATTIV and CMD_MANT into excitation currents for the windings of the electromagnet for the activation and subsequent maintenance phase, respectively.

In the example shown in FIG. 2, the signal CMD_ATTIV directly controls the gate of the MOSFET Q70, causing the current to circulate between VALIM and GND in the activation winding 201. The diode D70 intervenes to switch off the MOSFET Q70 so that the current can recirculate.

The signal CMD_MANT directly controls the gate of the MOSFET Q71, which causes the current to circulate between VALIM and GND in the series of activation 201 and maintenance windings 202. The diode D71 (together with the diode D70) intervenes to switch off the MOSFET Q71 so that the current can recirculate.

In a possible embodiment, the device 100 according to the invention comprises an additional sixth circuit block 70, or generator circuit for generating digital deactivation commands, which receives, at its input, the pre-deactivation signal Pre_Trigger from the second circuit unit 20 and transmits, at its output, the digital deactivation command CMD_DISATT for the actuator 200.

In particular, this digital command CMD_DISATT is kept active for a predefined time interval, or pulse duration of the command CMD_DISATT; this time interval can be regulated and set within the block 70 itself.

More in details, the time at which the signal CMD_DISATT is emitted is determined by the fulfilment of both of the following conditions: the actuator is excited, i.e. the excitation signal EM_ECC (or, if the optional unit 30, is not present) the pre-activation signal Pre_Trigger is active, and there is a state change of the signal Pre_Trigger from active to inactive, i.e., it passes from preactivation to pre-deactivation.

The duration of the deactivation command CMD_DISATT is appropriately commensurate to the time required for the recirculating current in the windings of the activator to be exhausted and the mechanical time required by the mobile armature to reach the resting position.

Furthermore, in a possible embodiment of the device 100, the deactivation signal CMD_DISATT for the actuator is also used to inhibit, for the duration of the deactivation interval or pulse duration of the command CMD_DISATT, a state change of the signal Pre_Trigger from a pre-deactivation signal to a preactivation signal, feeding it back to the AND gate 24 and the second circuit unit 20, as shown in FIG. 1.

In particular, the use of this block 70, implemented for instance in the form of the circuitry shown in FIG. 2, also allows for diagnosis of the windings of the actuator by means of external devices that monitor the continuity of the electrical circuit. This type of diagnostic is typically used for constant monitoring of the trip circuits of medium-voltage circuit breakers. For example, a typical circuit for monitoring the continuity of the trip actuator 200 of a switch (TCS—Trip Circuit Supervision) comprises a device that injects a current when a protection relay of the contacts of the circuit breaker is open, in order to verify that the actuator associated with the circuit breaker itself is connected and to verify the integrity of the windings.

In practice, during the diagnostic phase, the windings of the actuator 200 are always supplied with power as if the actuator were in the maintenance phase, allowing for the diagnostic current to circulate. The unit 70 generates a deactivation command CMD_DISATT the moment it becomes necessary to deactivate the actuator by interrupting not only the maintenance current but also the circulation of the diagnostic current in the windings; the duration of the deactivation command CMD_DISATT is sufficient, in any case, for the complete displacement of the mobile armature away from the fixed electromagnet of the actuator 200.

In the exemplary embodiment of FIG. 2, the circuit 70 for generating a deactivation command CMD_DISATT for the actuator 200 substantially comprises two parts: a network that supplies the polarisation voltage to the gate of the MOSFET Q71 (namely the signal CMD_MANT), which closes the supply circuit, for example of the activation 201 and maintenance windings 202, in which the Zener ZD80 diode limits the voltage below the level tolerated by the gate of the MOSFET Q71, and the resistor R82, which draws the polarisation current between the two windings so as to also verify the connection of the activation circuit of the actuator 200; and a network to generate the deactivation pulse CMD_DISATT, which controls the deactivation of the MOSFET Q71 itself, in which, as soon as the actuator 200 is activated (namely the signal EM_ECC becomes active high), the capacitor C80 is charged and stores the energy necessary to generate the deactivation pulse for the actuator. The deactivation of the actuator 200 is controlled by the signal PRETRIG_DISATT, which activates the MOSFET Q81, and, consequently, the MOSFET Q80; thus, the capacitor C80, that is no longer charged by the signal EM_ECC will discharge into the resistor R81 and the gate of the (N-type) MOSFET Q80. Thus, the signal CMD_MANT becomes inactive, and the current circulating in the activation 201 and maintenance 202 windings is interrupted for sufficient time to deactivate the actuator. The values of the capacitor C80 and the resistor R81 allow for this time period to be regulated. The diode D81 impedes that the deactivation of the actuator is interrupted by a sudden increase in supply voltage that may, typically, be caused by the interruption of the current in the activation and windings itself, which may also be due to the presence of circuits for monitoring the continuity of the actuator 200. The resistor R80 limits the charging current of the capacitor so as not to overload the supply+VDD, and the diode D80 prevents its discharge when the signal EM_ECC becomes low.

Figure 3:
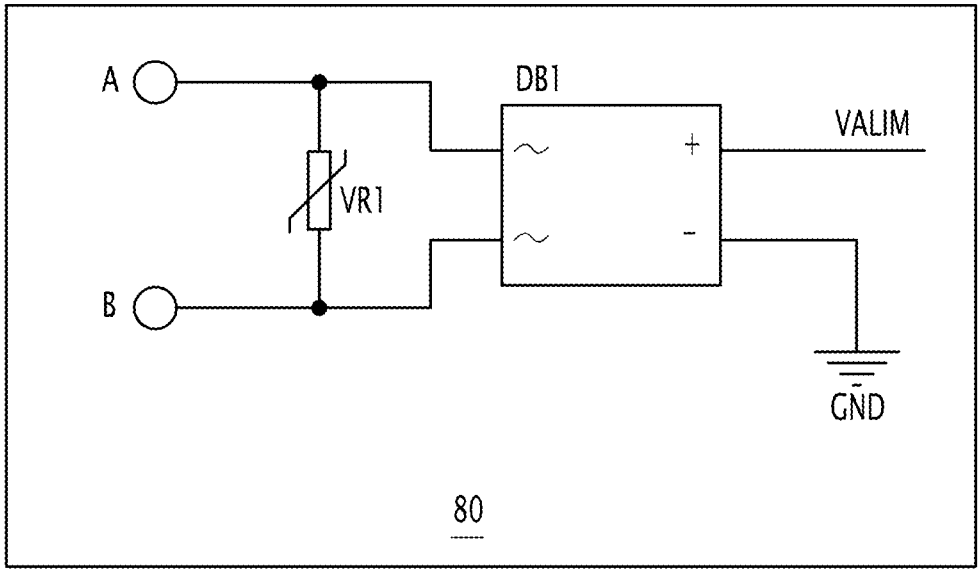
FIG. 3 shows one possible example of a power supply circuit for the windings of an actuator used in the command and control device according to the invention.
Figure 4:
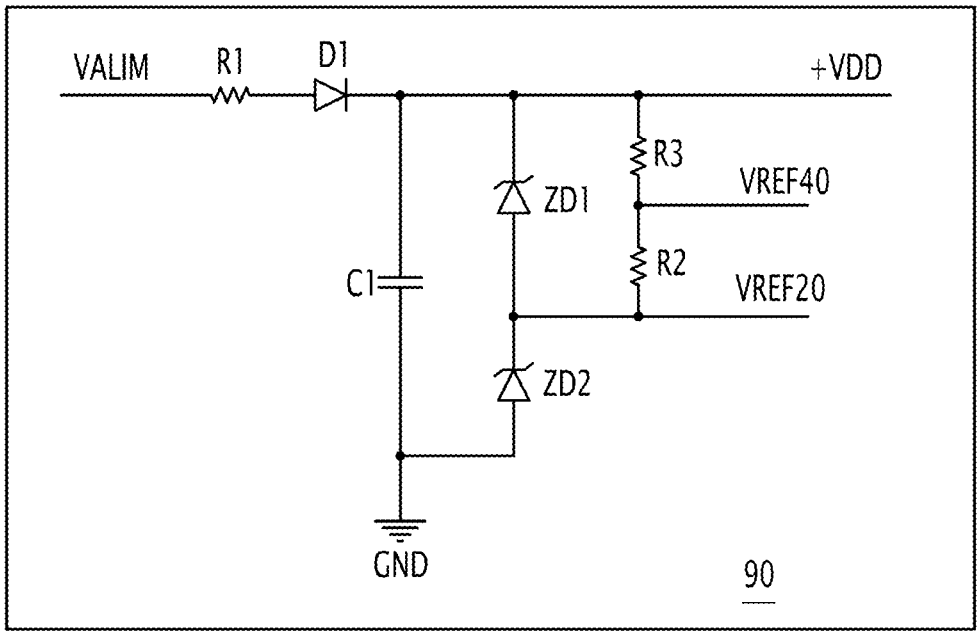
FIG. 4 shows one possible example of a circuit for generating a stabilised supply voltage and reference voltages used in the command and control device according to the invention.

FIGS. 3 and 4 respectively show one possible example of a supply circuit, indicated as a whole by reference number 80, and a circuit related to voltage references, indicated as a whole by the reference number 90, which represent one particular solution that constitutes a trade-off between low cost and certain features necessary for optimal functioning of the actuator 200. In particular, in the supply circuit 80, the supply voltage is applied to the terminals A and B; the varistor VR1 differentially protects the downstream circuits from overvoltages. A rectifier DB1, which may be configured, for example as a Graetz bridge, a single or double half-wave rectifier, is used in the event of AC power supply; in the case of DC power supply, the use of a diode to protect the circuit from accidental polarity inversions is usually provided. The output voltage VALIM substantially coincides with the supply voltage of the actuator, decreased by the voltage drop over the rectifier DB1.

Clearly, various alternative embodiments to that shown may be used.

With regard to the circuit 90 that generates the stabilised voltage +VDD from the supply voltage, in the device 100 according to the invention, the same circuit generates the voltage reference VREF20 (described in greater detail hereinafter), establishing the serial connection of two Zener diodes ZD1 and ZD2 instead of a cascade configuration that would require additional current for the polarisation of the ZD2 diode, with the Zener diodes that advantageously stabilises the voltage at low polarisation currents of the order of tens of μA, contrary to standard Zener diodes necessitating up to 10 mA. In this way, it is possible to significantly reduce energy dissipation in the resistor R1 and thus reduce cost and size whilst increasing overall reliability compared to the prior art.

The voltage value of VREF20 is determined by the Zener diode ZD2 and is used to generate the activation and deactivation thresholds of the actuator 200. In particular, the nominal value of the ZD2 diode is preferably selected around 6.2 V. In this way, the characteristic of dependency of the voltage from the temperature for Zener diodes with nominal voltages in this range is compensated with the dependency of the voltage drop in the diode D10 (FIG. 2) as a function of the temperature. Hence, this allows obtaining an acceptable thermal compensation without resorting to more complex and expensive circuits.

Furthermore, with reference to the activation and deactivation thresholds of the actuator 200, the voltage tolerances of Zener diodes and the various resistors involved (R10, R11, R12, R20, R21, R22, and R23) must be taken into account; in order to reduce the initial error of these thresholds, it is possible to make some of these resistors adjustable in the calibration phase of the circuit before it is put into service.

The capacitor C1 is useful for levelling the supply voltage +VDD that, in the case of AC power supply, may be affected by elevated ripple. The value of C1 is selected based on a compromise between the ripple acceptable for the supply voltage +VDD and the time necessary to charge C1 via the resistor R1. This time is particularly critical because it has an influence on the activation delay of the actuator 200 and also depends on the voltage actually applied to the terminals A and B with respect to the nominal supply voltage value. The diode D1 is useful for applications with AC supply and the presence of voltage drops and/or dips in order to prevent the capacitor C1 from discharging via the windings of the electromagnet. The resistors R2 and R3 allow for suitable determination of the value of VREF40 and thus the activation times and the periods of immunity to voltage drops. The decision to connect the voltage divider in parallel only to the Zener diode ZD1 represents a particular solution allowing for additional reduction of the polarization consumption of the Zener ZD2 diode such that, in the event of increases in supply voltage, the voltage at its ends (VREF20) increases accordingly, first reaching its desired value. This prevents the comparator U20 from entering abnormal conditions that may cause erratic, unintended behaviours of the circuit at low supply voltages.

It has been thus ascertained that the device 100 according to the invention meets the aforementioned aim and objectives. In particular, the device 100 can be used either with DC or AC power sources, and with a wide range of supply voltages, in which the intervention thresholds can be easily and suitably calibrated on a case-by-case basis, and the intervention times can be adjusted.

The device 100 can be also used with diagnostic devices for the windings of an electromagnetic actuator, and can be used with nearly any type of windings used in the actuator itself, e.g. single winding, double windings with activation and maintenance windings in series, or with excitation and diagnostic windings wound in opposite directions to each other. Furthermore, the device 100 can be easily used to excite windings via simple switches or voltage dividing systems, for example with partialized pulsed currents (PWM).

Thus, the present invention encompasses also an electromagnetic actuator 200 comprising one or more windings, and a device 100 as described above for the command and control of the power supply of the one or more windings.

Furthermore, the device 100 is able to better combine and optimise the functional characteristics of configurability, scalability, and low cost compared to prior-art solutions due to the use of components with extremely low consumption and discrete low-cost components, such as diodes and MOSFETs, such as the four push-pull comparators U20, U30, U40, U50 with reduced parasitic effects suitable to maximise the values of the various resistors present in the circuit, maintaining at the same time the tolerances of the thresholds and time delays within operatively acceptable ranges.

Of course, without prejudice to the principle of the invention, the embodiments and specific implementations may be widely varied from the purely exemplary descriptions and illustrations herein without leaving the scope of this invention as defined in the claims appended hereto. For example, in relation to the exemplary embodiment of FIG. 2, one or more of the signals generated in the various units and/or circuit parts of the device 100 can be optimised as high or low depending on application and/or specific circuit optimisations.

The invention claimed is:

1. A device for the command and control of the electric power supply of one or more windings of an electromagnetic actuator, wherein it comprises a plurality of electronic means configured to receive at the input either a direct current feeding voltage or alternatively an alternating current feeding voltage and to generate at the output a first digital command signal suitable for triggering an activation phase of the electromagnetic actuator in which at least one of said one or more windings is powered, for a first predefined and adjustable time interval, with an activation current, a second digital command signal suitable for triggering a maintenance phase of the electromagnetic actuator in which said one or more windings are powered with a maintenance current having an intensity lower than said activation current, and a third digital command signal suitable for triggering at least a third phase of deactivation of the electromagnetic actuator in which the power supply of said one or more windings is interrupted for at least a second predefined and adjustable time interval, wherein said plurality of electronic means comprises:

a first circuit block configured to generate at the output a reference voltage adjusted to a desired value responsive to the value of the feeding voltage in direct current or in alternating current received at the input, and a second circuit block which receives in input at least said reference voltage and is configured to generate in output a signal of pre-activation suitable to bring the electromagnetic actuator in said activation phase, or a signal of pre-deactivation suitable to bring the electromagnetic actuator in said deactivation phase.

2. The device according to claim 1, wherein said plurality of electronic means further comprises a third circuit block which receives in input said pre-activation signal and is configured to output a corresponding validated excitation signal suitable to actually trigger said activation phase of the electromagnetic actuator only after the pre-activation signal received at the input remains active at the input for a predetermined adjustable time interval.

3. The device according to claim 2, wherein said plurality of electronic means further comprises a fourth circuit block which receives in input alternatively said validated excitation signal or said pre-activation signal or said pre-deactivation signal and is configured to generate in output a control signal variable between a first inactive state when said one or more windings are in said deactivation phase and a second active state when said one or more windings are in said maintenance phase, said fourth circuit block being configured so that the control signal generated at the output passes from the first inactive state to the second active state after a first time interval has elapsed following the change of the signal received at the input from a pre-deactivation signal to a validated excitation signal or to a pre-activation signal, and passes from the second active state to the first inactive state after a second time interval has elapsed following the change of the signal received at the input from a validated excitation signal or from a pre-activation signal to a pre-deactivation signal, said first and second time intervals being adjustable and different from each other.

4. The device according to claim 2, wherein said plurality of electronic means further comprises a fifth circuit block which is configured to receive in input said validated excitation signal or said pre-activation signal and said control signal, and to generate in output said first digital command signal when the excitation signal or the pre-activation signal is active and the control signal is in said second inactive state.

5. The device according to claim 2, wherein said sixth circuit block is configured to generate said third digital command signal for a predetermined interval of time when the validated excitation signal at the output of the third circuit block or the pre-activation signal at the output of the second circuit block is active and the signal generated at the output of the second circuit block passes from a pre-activation signal to a pre-deactivation signal.

6. The device according to claim 1, wherein said second digital command signal is generated selectively starting from the pre-activation or pre-deactivation signal generated at the output of the second circuit block.

7. The device according to claim 1, wherein said plurality of electronic means further comprises a sixth circuit block which is configured to receive in input said pre-activation signal and to generate in output said third digital command signal, said third digital command signal being further supplied as a feedback signal in input to said second circuit block.

8. An electromagnetic actuator comprising one or more windings, wherein it further comprises at least one device according to claim 1 for the command and control of the electric power supply of said one or more windings.

* * * * *